US007532191B2

(12) United States Patent
Kim

(10) Patent No.: US 7,532,191 B2
(45) Date of Patent: May 12, 2009

(54) APPARATUS, METHOD AND COMPUTER PROGRAM PRODUCT FOR CONTROLLING SCREEN BRIGHTNESS OF MOBILE TERMINAL

(75) Inventor: No-Soon Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 688 days.

(21) Appl. No.: 10/815,837

(22) Filed: Apr. 2, 2004

(65) Prior Publication Data

US 2004/0196252 A1 Oct. 7, 2004

(30) Foreign Application Priority Data

Apr. 4, 2003 (KR) ..... 10-2003-0021493

(51) Int. Cl.
*G09G 3/34* (2006.01)

(52) U.S. Cl. ..... 345/102; 345/77

(58) Field of Classification Search ..... 345/102, 345/77, 84; 348/362, 222.1; 250/338.1
See application file for complete search history.

(56) References Cited

U.S. PATENT DOCUMENTS 4,352,105 A * 9/1982 Harney ..... 250/338.1
6,597,339 B1 * 7/2003 Ogawa ..... 345/102
7,053,881 B2 * 5/2006 Itoh ..... 345/102
7,158,173 B2 * 1/2007 Lee et al. ..... 348/222.1
2005/0041139 A1 * 2/2005 Lowles ..... 348/362

FOREIGN PATENT DOCUMENTS

| | | |
|---|---|---|
| JP | 2000-182045 | 6/2000 |
| JP | 2001-223792 | 8/2001 |
| JP | 2002-344598 | 11/2002 |
| JP | 2003-110681 | 4/2003 |
| KR | 2003-0005539 | 1/2003 |

* cited by examiner

*Primary Examiner*—Amare Mengistu
*Assistant Examiner*—Yuk Chow
(74) *Attorney, Agent, or Firm*—Ked & Associates, LLP

(57) ABSTRACT

An apparatus, method and computer program product for controlling a screen brightness value of a terminal having a camera and including a controller which controls the terminal to sense an illumination intensity around the terminal and to determine a level of the illumination intensity. Also included is a display unit which controls the screen brightness value of the terminal based on the level of illumination intensity determined by the controller.

22 Claims, 3 Drawing Sheets

| BRIGHTNESS PEAK VALUE | ILLUMINATION INTENSITY VALUE |
|---|---|
| 1~50 | 5 |
| 51~100 | 4 |
| 101~150 | 3 |
| 151~200 | 2 |
| 201~ | 1 |

APPARATUS, METHOD AND COMPUTER PROGRAM PRODUCT FOR CONTROLLING SCREEN BRIGHTNESS OF MOBILE TERMINAL

BACKGROUND OF THE INVENTION

1. Field of the Invention

The present invention relates to a mobile terminal, and more particularly to an apparatus, method and computer program product for controlling the screen brightness of a mobile terminal.

2. Description of the Background Art

Recently, in line with the rapid development in mobile communication technology enabling image communications, an LCD (Liquid Crystal Display) is commonly used for mobile terminals and camera-attached mobile terminals are increasingly being used.

The LCD is advantageous in that text, pictures, animations or the like can be freely expressed and power consumption is low. However, a disadvantage with the LCD is that a display content can not be easily recognized in the dark. Due to such a disadvantage, LCD terminals use a backlight at a rear surface of the LCD.

In general, the backlight of the terminal is turned on according to a user's action such as when the user initiates or receives a phone call, presses a key or opens a folder. Then, the intensity of light (the intensity of illumination) emitted by the backlight is set to be suitable for the darkest situation around the terminal (or the user).

Further, the backlight used for the terminal is a device that consumes a relatively large amount of power. In the related art, the backlight is simply controlled to be turned on or off.

In addition, because the intensity of illumination of the backlight set for the terminal is designed to be suitable for night time or a dark room, it is inappropriate for most people that are active during the day or in areas with lighting. In addition, the battery usage time is reduced because of the large consumption of power.

SUMMARY OF THE INVENTION

Accordingly, one object of the present invention is to solve the above-noted and other problems.

Another object of the present invention is to provide a novel apparatus, method and computer program product for controlling a screen brightness of a mobile terminal by which the intensity of illumination around a mobile terminal is measured and the screen brightness of the mobile terminal is controlled according to the measured value.

To achieve these objects in whole or in parts, the present invention provides a novel apparatus for controlling the screen brightness of a mobile terminal having a camera. The apparatus includes a controller which controls the mobile terminal to sense an illumination intensity around the mobile terminal and to determine a level of the illumination intensity, and a display unit which controls the screen brightness value of the mobile terminal based on the level of illumination intensity determined by the controller. The present invention also provides a novel method and computer program product for controlling the screen brightness of a mobile terminal.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

A preferred embodiment of the present invention will now be described with reference to the accompanying drawings.

Figure 1:
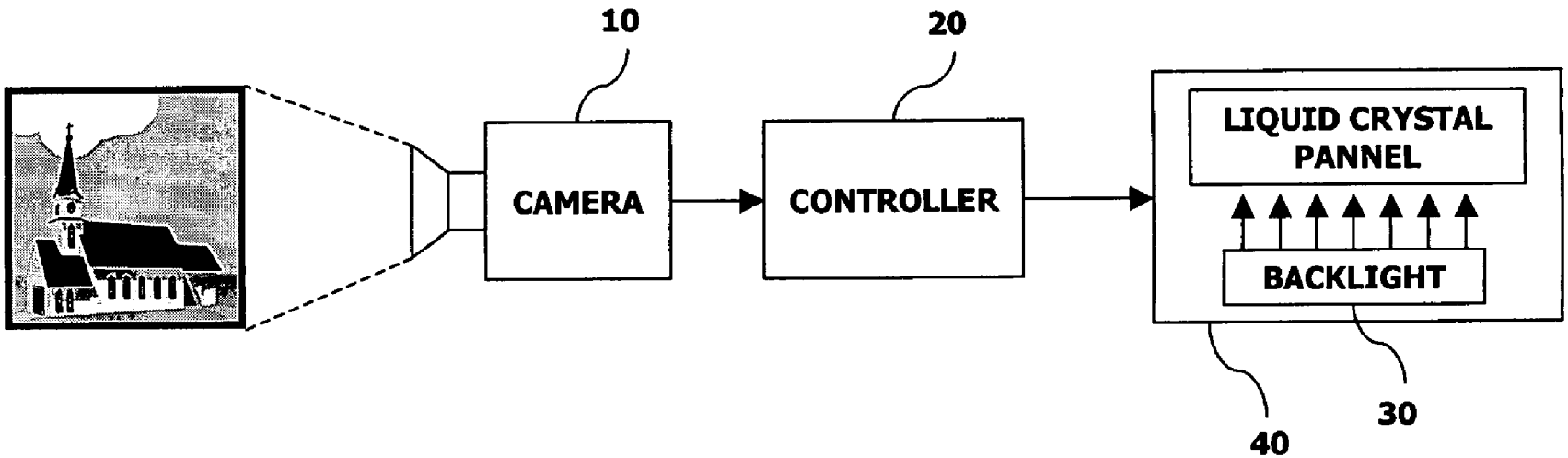
FIG. 1 is a schematic block diagram of a screen brightness controlling apparatus in accordance with a preferred embodiment of the present invention.

As shown in FIG. 1, an apparatus for controlling the screen brightness of a mobile terminal includes a camera 10 for photographing an object and generating a corresponding image, and a display unit 40 for controlling a brightness of a backlight 30 according to a determined illumination intensity level. Also included is a controller 20 for controlling the camera 10 to sense an intensity of illumination around the terminal when a user operates the terminal and then to determine a level of the sensed intensity of illumination.

Further, the backlight 30 is a device for emitting light of different strengths according to inputted voltage values.

Figure 2:
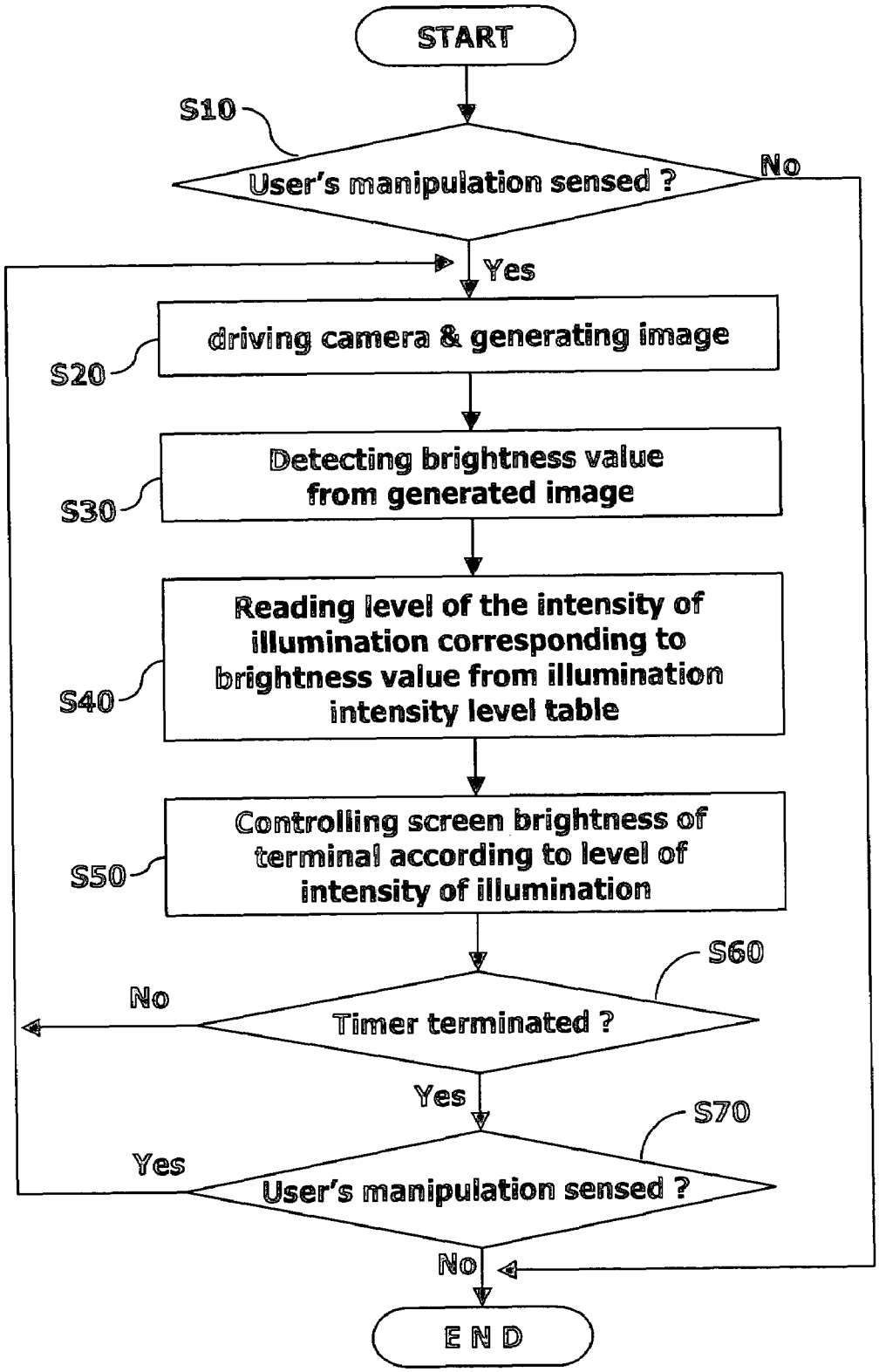
FIG. 2 is a flowchart of a screen brightness controlling method in accordance with the preferred embodiment of the present invention.

Next, FIG. 2 is a flow chart of a screen brightness controlling method in accordance with a preferred embodiment of the present invention. An operation of the mobile terminal will be described as follows with reference to FIG. 2.

When a user's action of the terminal (e.g., pressing a key, opening a folder, etc.) is sensed (step S10), the controller 20 controls the camera 10 to photograph an object (or a scene) captured by a lens of the camera 10 and then generates a corresponding digital image (step S20). The minimum unit of a digital image is a pixel, and each pixel has a brightness value (or brightness information).

Figures 3, 4:
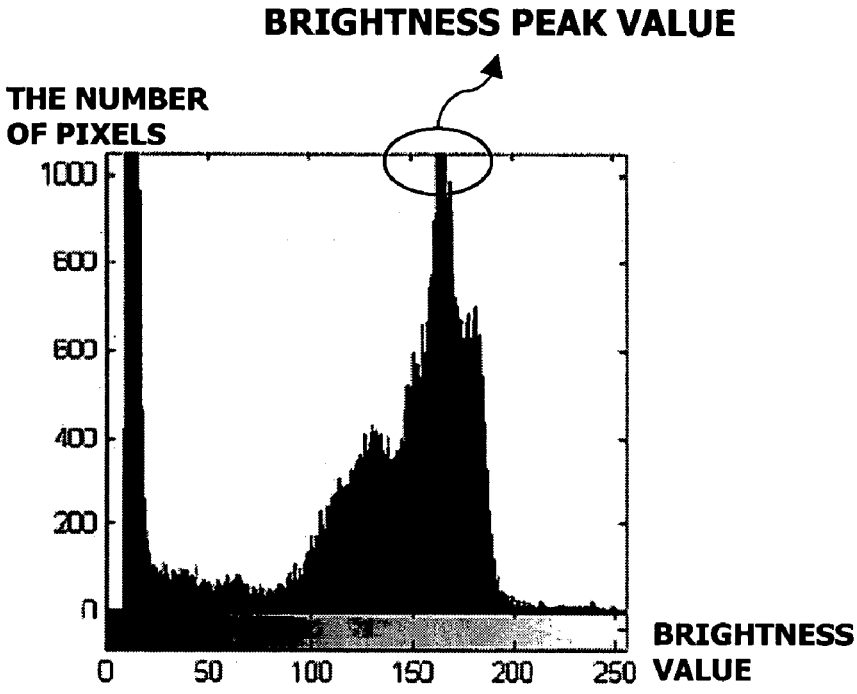
FIG. 3 is a histogram showing a distribution of brightness values.
FIG. 4 illustrates an illumination intensity level table.

Then, the controller 20 checks each brightness value of the pixels and produces a histogram for the number of pixels and brightness values. Next, the controller 20 determines the most frequently detected brightness value (hereinafter referred to as 'a brightness peak value') from the brightness values of pixels. FIG. 3 illustrates an example of a histogram in which the horizontal axis indicates brightness values and the vertical axis indicates the number of pixels.

When the brightness peak value is found, the controller 20 reads a level of the intensity of illumination corresponding to the brightness peak value from an illumination intensity level table and transfers it to the display unit 40.

In addition, when the display unit 40 receives the illumination intensity level signal, the backlight 30 of the display unit 40 emits light having the intensity corresponding to a voltage value of the received signal (steps S40 and S50). The size of the illumination intensity level value is proportional to the intensity of the voltage value.

Once the user's manipulation is sensed, the terminal repeatedly performs the above described processes (steps S20~S50). As the processes (steps S20~S50) are repeatedly performed, the brightness of the display unit 40 is adaptively changed in accordance with a change in the surroundings illumination intensity. Further, when the user's manipulation is sensed, the controller 20 operates an internal timer. Also, the repetition time period of the processes (steps S20~S50) can be changed as desired by the user.

Thus, the controller 20 continuously controls the mobile terminal to sense the illumination intensity and to determine the level of illumination intensity, and the display unit 40 continuously controls the screen brightness value of the mobile terminal. If the predetermined time period has expired and a user then manipulates or uses the mobile terminal (YES in steps S60 and S70), the controller 20 again starts controlling the mobile terminal to sense the illumination intensity and to determine the level of illumination intensity, and the display unit 40 again starts controlling the screen brightness value of the mobile terminal.

However, if the timer expires (YES in step S60) and the user's manipulation is not sensed (NO in step S70), the process ends. If the time is not expired (NO in step S60), steps S20~S50 are repeated.

Next, FIG. 4 illustrates in the illumination intensity level table in which ranges from a maximum brightness value to a minimum brightness value are divided into several brightness peak value sections and illumination intensity levels are defined corresponding to each brightness peak value section. Further, illumination intensity level is a control signal that can optimize illumination of the backlight 30 in a corresponding brightness peak value section.

As so far described, the apparatus and method for controlling the screen brightness of a mobile terminal have the following advantages.

That is, for example, as soon as the user's manipulation of the terminal is sensed, the screen brightness is automatically controlled for the user's convenience. In addition, because the screen brightness of the terminal is controlled according to the intensity of illumination around the terminal, the amount of power consumed for the backlight can be reduced.

In addition, the present invention includes a computer program product which is a storage medium including instructions which can be used to program a computer to perform a process of the invention. The storage medium can include, but is not limited to, any type of disk including floppy disks, optical discs, CD-ROMs, and magneto-optical disks, ROMs, RAMs, EPROMs, EEPROMs, magnetic or optical cards, or any type of media suitable for storing electronic instructions.

Further, this invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software are. The invention may also be implemented by the preparation of application specific integrated circuits or by interconnecting an appropriate network of conventional component circuits, as will be readily apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An apparatus for controlling a screen brightness value of a terminal comprising:

a controller that controls the terminal to sense an illumination intensity of a photographed object around the terminal, the photographed object comprising a digital image having a plurality of pixels, the controller to determine a level of the illumination intensity from a data table based on a most frequently detected brightness value of the pixels in the digital image, wherein the data table includes a first range of brightness peak values and a second range of brightness peak values different than the first range of brightness peak values, the data table further including a first illumination intensity value corresponding to the first range of brightness peak values and a second illumination intensity value corresponding to the second range of brightness peak values, wherein the controller determines that the most frequently detected brightness value falls within the first range of brightness peak values and the controller reads the first illumination intensity value from the data table based on the most frequently detected brightness value; and a display unit that controls the screen brightness value of the terminal based on the first illumination intensity value read from the data table by the controller based on the most frequently detected brightness value that falls within the first range of brightness peak values.

2. The apparatus according to claim 1, wherein the terminal includes a camera.

3. The apparatus according to claim 2, wherein the controller controls the camera to photograph the object when a user manipulates or uses the terminal.

4. The apparatus according to claim 1, wherein the display unit sets the screen brightness value of the terminal based on the most frequently detected brightness value of the pixels in the digital image.

5. The apparatus according to claim 1, wherein, for a predetermined time period, the controller continuously controls the terminal to sense the illumination intensity and to determine the level of illumination intensity, and the display unit continuously controls the screen brightness value of the terminal.

6. The apparatus according to claim 5, wherein when the predetermined time period has expired and a user then manipulates or uses the terminal, the controller again starts controlling the terminal to sense the illumination intensity and to determine the illumination intensity value, and the display unit again starts controlling the screen brightness value of the terminal.

7. The apparatus according to claim 1, wherein the terminal is a mobile terminal.

8. A method for controlling a screen brightness value of a terminal comprising:

controlling the terminal to sense an illumination intensity of a digital image having a plurality of pixels and to determine a level of the illumination intensity, from a data table storing information related to different illumination intensity levels, based on a most frequently detected brightness value of the pixels, wherein the data table includes a first range of brightness peak values and a second range of brightness peak values different than the first range of brightness peak values, the data table further including a first illumination intensity value corresponding to the first range of brightness peak values and a second illumination intensity value corresponding to the second range of brightness peak values, wherein the controlling includes reading the first illumination intensity value from the data table based on the most frequently detected brightness value corresponding to the first range of brightness peak values; and controlling the screen brightness value of the terminal based on the first illumination intensity value read from the data table.

9. The method according to claim 8, wherein the terminal includes a camera, and wherein the terminal is controlled to sense the illumination intensity by controlling the camera to photograph an object around the terminal.

10. The method according to claim 9, wherein the camera is controlled to photograph the object when a user manipulates or uses the terminal.

11. The method according to claim 9, wherein the photograph comprises the digital image.

12. The method according to claim 11, further comprising:

setting the screen brightness value of the terminal based on the most frequently detected brightness value of the pixels in the digital image.

13. The method according to claim 9, wherein, for a predetermined time period, the terminal is continuously controlled to sense the illumination intensity and to determine the level of illumination intensity, and the screen brightness value of the terminal is continuously controlled.

14. The method according to claim 13, wherein when the predetermined time period has expired and a user then manipulates or uses the terminal, the terminal is again controlled to sense the illumination intensity and to determine the illumination intensity value, and the screen brightness value of the terminal is again controlled.

15. The method according to claim 8, wherein determining the illumination intensity value includes:

reading the first illumination intensity value from the data table based on the most frequently detected brightness value of the pixels corresponding to the first range of brightness peak values, wherein the screen brightness value of the terminal is controlled based on the first illumination intensity value read from the data table.

16. The method according to claim 8, wherein the terminal is a mobile terminal.

17. A computer program product comprising a processor-useable medium having a processor-readable program, wherein the processor-readable program when executed causes the processor to control a screen brightness value of a terminal, comprising:

a first instruction for causing a computer executing said instruction to control the terminal to sense an illumination intensity of a photographed object around the terminal, the photographed object comprising a digital image having a plurality of pixels, the first instruction to determine a level of the illumination intensity from a data table based on a most frequently detected brightness value of the pixels in the digital image, wherein the data table includes a first range of brightness peak values and a second range of brightness peak values different than the first range of brightness peak values, the data table further including a first illumination intensity value corresponding to the first range of brightness peak values and a second illumination intensity value corresponding to the second range of brightness peak values, wherein the first instruction causes the computer executing the instruction to determine that the most frequently detected brightness value falls within the first range of brightness peak values and the first instruction causes the computer to read the first illumination intensity value from the data table based on the most frequently detected brightness value of the pixels; and a second instruction for causing a computer executing said instruction to control the screen brightness value of the terminal based on the first illumination intensity value read from the data table by the first instruction based on the most frequently detected brightness value that corresponds to the first range of brightness peak values.

18. The computer program product according to claim 17, wherein the terminal includes a camera.

19. The computer program product according to claim 18, wherein the first instruction causes the computer executing the instruction to control the camera to photograph the object when a user manipulates or uses the terminal.

20. The computer program product according to claim 17, wherein the second instruction causes the computer executing the instruction to set the screen brightness value of the terminal based on the most frequently detected brightness value of the pixels in the digital image corresponding to the first range of brightness peak values.

21. The computer program product according to claim 17, wherein, for a predetermined time period, the first instruction causes the computer executing the instruction to continuously control the terminal to sense the illumination intensity and to determine the illumination intensity value, and the second instruction causes the computer executing the instruction to continuously control the screen brightness value of the terminal.

22. The computer program product according to claim 21, wherein when the predetermined time period has expired and a user then manipulates or uses the terminal, the first instruction causes the computer executing the instruction to again start controlling the mobile terminal to sense the illumination intensity and to determine the illumination intensity value, and the second instruction causes the computer executing the instruction to again start controlling the screen brightness value of the terminal.

* * * * *